United States Patent [19]

Palmer et al.

[11] Patent Number: 4,848,661

[45] Date of Patent: Jul. 18, 1989

[54] SPRINKLER HEAD SHUTOFF VALVE

[75] Inventors: James D. Palmer; Michael W. Stuart, both of Phoenix, Ariz.

[73] Assignee: Stuart & Associates, Inc., Phoenix, Ariz.

[21] Appl. No.: 172,447

[22] Filed: Mar. 24, 1988

[51] Int. Cl.[4] ..... B05B 15/10

[52] U.S. Cl. ..... 239/204; 239/207; 137/68.1; 137/329.4

[58] Field of Search ..... 239/200–207, 239/273, 276, 285, 570, 571; 137/68.1, 329.1, 329.2, 329.4

[56] References Cited

U.S. PATENT DOCUMENTS

| | | | |
|---|---|---|---|
| 542,024 | 7/1895 | McIlhenny . | |
| 1,394,332 | 10/1921 | Myer . | |
| 1,762,503 | 6/1930 | Buckner | 239/201 X |
| 2,926,690 | 3/1960 | Martin | 137/460 |
| 3,971,403 | 7/1976 | Sergent | 137/459 |
| 4,033,374 | 7/1977 | Danon | 137/461 |
| 4,064,889 | 12/1977 | Gayle et al. | 137/68.1 |
| 4,562,962 | 1/1986 | Hartman | 239/207 X |

FOREIGN PATENT DOCUMENTS 2351335 1/1978 France .

*Primary Examiner*—Andres Kashnikow
*Assistant Examiner*—Patrick N. Burkhart
*Attorney, Agent, or Firm*—Cahill, Sutton & Thomas

[57] ABSTRACT

A sprinkler head shutoff valve for use with underground lawn sprinkler systems includes a central housing including a lower water inlet port and an upper water exit port. The lower water entry port may include a threaded male fitting for threadedly engaging a conventional plastic tee or elbow connector of the type often used in underground sprinkling systems. The upper water exit port includes an internally threaded female fitting for engaging a conventional plastic riser tube interconnecting the shutoff valve to a sprinkler head. A spring-biased plunger is disposed within the housing for engaging a gasket encircling the water exit port to seal off the flow of water therethrough. A rod having a length slightly greater than that of the riser tube is inserted within the riser tube and depresses the plunger for allowing water to flow to the sprinkler head. If the sprinkler head is removed or is broken off, the rod is released, and the plunger advances to its sealed position and stops any further flow of water therethrough.

3 Claims, 1 Drawing Sheet

FIG. 1
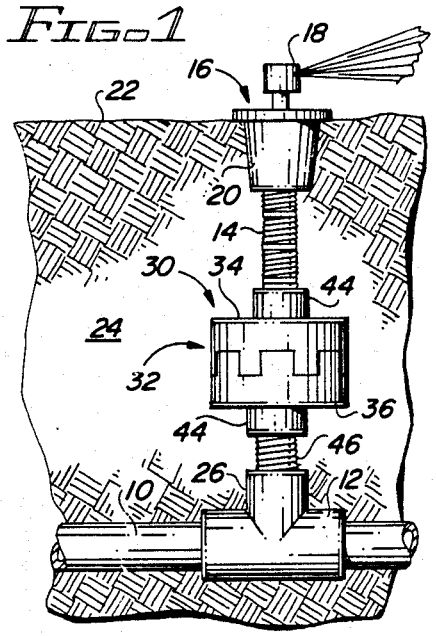
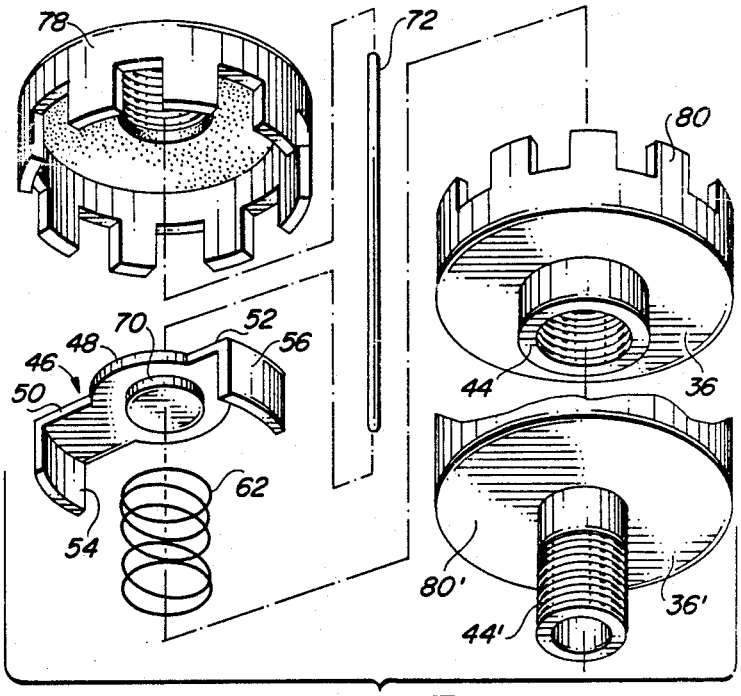
FIG. 3
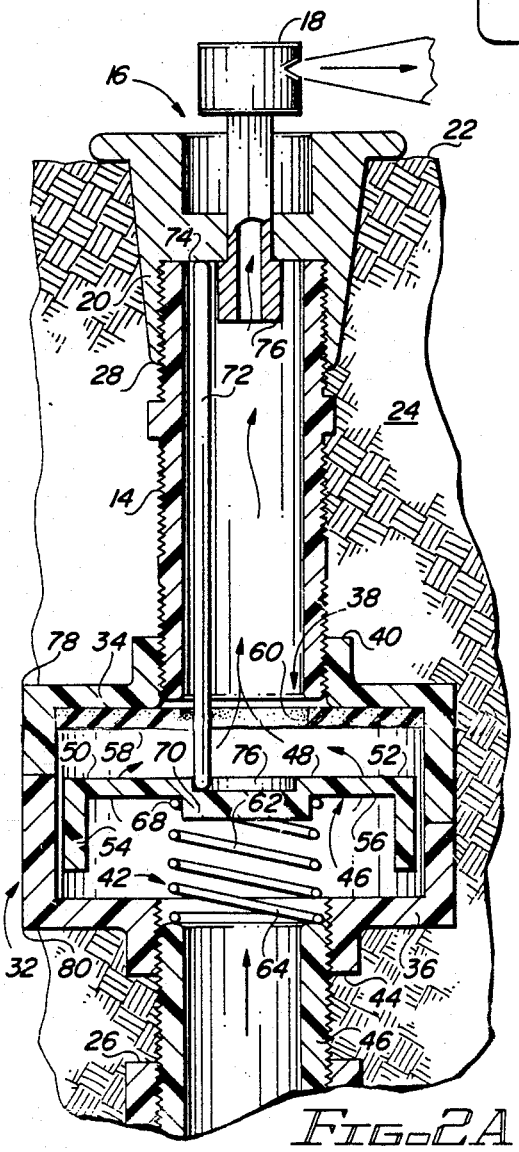
FIG. 2A
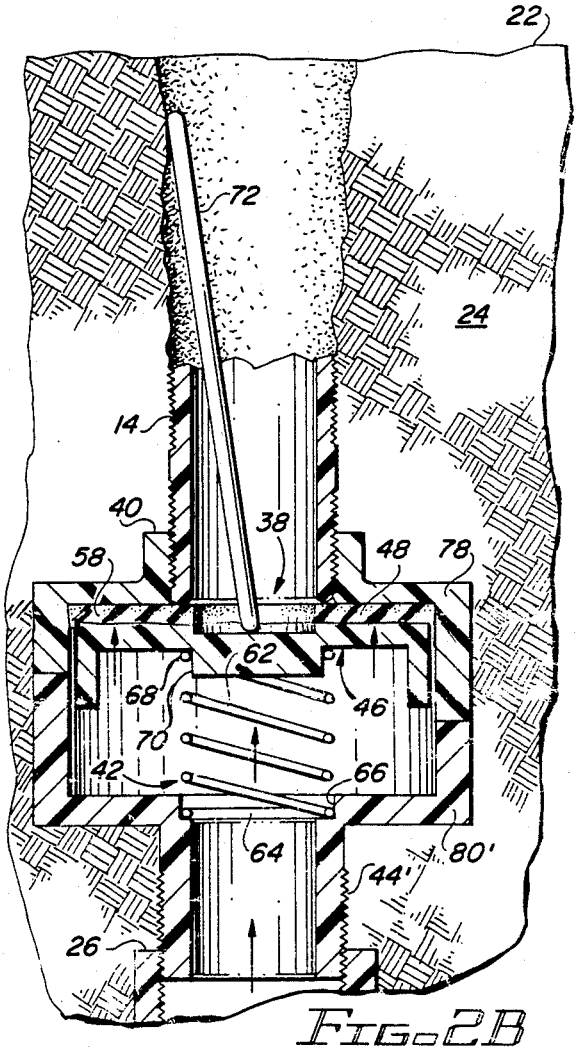
FIG. 2B

SPRINKLER HEAD SHUTOFF VALVE

BACKGROUND OF THE INVENTION

1. Field of the Invention

The present invention relates generally to underground lawn and garden sprinkling systems, and more particularly, to a shutoff valve for use with the sprinkler heads installed in such systems for preventing excessive water loss as a result of broken or missing sprinkler heads.

2. Description of the Prior Art

Underground lawn and garden sprinkling systems have long been in common use for periodically supplying water to lawns, gardens, shrubbery and other vegetation. Such underground lawn sprinkling systems include a number of sprinkler heads, sprayers or bubblers adapted to apply water in a desired spray pattern to a lawn, garden, or shrubbery. Sprinkler heads used to water lawn areas are typically mounted flush with ground level to avoid interference with lawn mowers and other lawn working equipment. Typically, the sprinkler heads are coupled by vertically-extending plastic riser tubes to a plastic tee or elbow connector. The lower ends of such plastic riser tubes typically include a male externally threaded fitting for threadedly engaging a female internally threaded port of the tee or elbow connector. The aforementioned tee and elbow connectors are, in turn, connected to a buried water delivery pipe, often made of polyvinyl chloride. Water from a central water supply, such as a municipal water system, is typically coupled to a system of control valves which are manually or automatically opened to selectively gate water to one or more of such water delivery pipes.

The aforementioned sprinkler heads, sprayers and bubbler heads are often made of plastic, and are easily broken when impacted by the cutting blade of a lawnmower or other lawn working equipment. Occasionally, even the pressure of water supplied to the sprinkler heads will, over time, cause the sprinkler heads to unthread from the upper end of the riser and be disconnected therefrom. Even if the sprinkler head is itself made of metal or is otherwise quite sturdy, the plastic riser tubes used to interconnect such sprinkler heads to the buried water delivery pipes are themselves somewhat fragile, and a strong impact to the sprinkler head can often shatter and break the plastic riser tube along its length.

When either the sprinkler heads or the plastic riser tubes are damaged, or the sprinkler heads otherwise become disconnected from the sprinkling system, as described above, a fountain of water, or geyser, is usually seen squirting high into the air out of the ground from the upper end of the riser tube. In addition, because the water pressure in the remaining portion of the underground water delivery pipe is thereby lessened, the remaining sprinkler heads interconnected to that circuit no longer provide sufficient water coverage over their intended spray pattern. Moreover, when the circuit containing the damaged sprinkler head is later shutoff, dirt, mud and small pebbles may seep into the broken riser, thereby contaminating the circuit and causing other sprinkler heads to become clogged when the system is again pressurized.

A damaged or missing sprinkler head often goes unnoticed for days or weeks, particularly if the water control valves are interconnected to a timer, as is often the case. Since the timer eliminates the need for an operator to manually open and close the control valves, it is typical for watering cycles to occur when no one is present to detect a damaged or missing sprinkler head. Moreover, in commercial and municipal watering systems, the sprinkler heads may be physically remote from the control valves associated therewith, and even manual operation of the control valves would not guarantee that the operator would notice such a problem. Furthermore, in hot arid climates like the desert southwest, watering is often timed to occur during nighttime hours to minimize water loss by evaporation. Obviously, detection of damaged or missing sprinkler heads is difficult when watering occurs in the dark.

As mentioned above, a damaged or missing sprinkler head results in an excessive amount of water being applied at the site of the damaged or missing sprinkler head, causing flooding at such site, while resulting in insufficient watering at other points that are intended to be watered by the same circuit. The result is that a great deal of water can be wasted, while the insufficiently watered areas of the lawn eventually discolor and die.

Accordingly, it is an object of the present invention to provide a sprinkler head shutoff valve adapted to sense that a sprinkler head, sprayer, or bubbler has been removed or has broken off from an underground sprinkling system and to prevent any further flow of water at the stie of the missing or damaged sprinkler head.

It is another object of the present invention to provide such a shutoff valve which maintains the water pressure within the circuit that is the interconnected with the damaged or missing sprinkler head for allowing other sprinkler heads supplied with water by the same circuit to function normally.

It is still another object of the present invention to provide such a shutoff valve which prevents the contamination of the underground water delivery pipe with dirt, pebbles or other debris at the site of the broken or missing sprinkler head, and thereby prevents other sprinkler heads from becoming clogged with such debris.

It is a further object of the present invention to provide such a shutoff valve which is of simple and inexpensive construction and which may be easily and quickly installed within new or existing underground sprinkling systems.

These and other objects of the present invention will become more apparent to those skilled in the art as the description thereof proceeds.

SUMMARY OF THE INVENTION

Briefly described, and in accordance with one embodiment thereof, the present invention relates to a sprinkler head shutoff valve for stopping the flow of water through a sprinkler head for a sprinkler system, the shutoff valve including a housing having a generally hollow central body and including a lower water entry port and an upper water exit port. The water entry port is adapted to be coupled to a water delivery pipe for delivering water to the central body of the housing of the shutoff valve. The water exit port is in fluid communication with the central body of the housing and is adapted to be coupled to a sprinkler head for delivering water thereto. A valve seal member, or plunger, is disposed within the housing generally near the water exit port and is supported for movement between an opened position spaced apart from the water exit port, and a closed position for sealing the water exit port. A depressor, which may be in the form of an elongated rod, extends through the water exit port and has a first end for contacting the sprinkler head and an opposing second end for depressing the valve seal member to maintain it in its opened position. In the event that the sprinkler head is uncoupled from the water exit port, as by being removed or broken off, then the upper end of the depressor no longer engages the sprinkler head, and the valve seal member is thereafter permitted to advance to its closed position for stopping any further flow of water through the water exit port.

In its preferred embodiment, the shutoff valve includes a coiled spring or other biasing device within the housing for urging the valve seal member toward its closed position. Under normal circumstances, the depressor overcomes the biasing force of the spring to maintain the valve seal member in its opened position. However, when the sprinkler head is uncoupled from the water exit port, the coiled spring or other biasing device raises the depressor and seals the valve seal member against the water exit port. A gasket made of rubber or another elastic material preferably surrounds the water exit port to create a more effective seal when the valve seal member is urged against the water exit port.

In its preferred embodiment, the water exit port of the sprinkler head shutoff valve includes an internally threaded female coupler for threadedly engaging the lower end of a conventional sprinkler head riser tube, the upper end of which threadeldy engages the sprinkler head in the usual manner. The length of the depressor or rod is selected to be in excess of the length of the riser tube in order to maintain the valve seal member spaced apart from the water exit port for so long as the sprinkler head and riser tube remain intact with the shutoff valve.

The lower water entry port of the shutoff valve is preferably formed as either a male, externally-threaded fitting for directly engaging a female internally-threaded fitting of a tee, elbow or other sprinkler system connector, or as a female internally-threaded fitting for receiving a second lower riser tube for coupling to the tee, elbow or other connector.

BRIEF DESCRIPTION OF THE DRAWINGS

FIG. 1 is a side, cutaway view of a portion of an underground sprinkling system incorporating a sprinkler head shutoff valve constructed in accordance with the teachings of the present invention.

FIG. 2A is an enlarged, cross-sectional view of the sprinkler head, plastic riser tube and shutoff valve shown in FIG. 1 and illustrating the manner in which the shutoff valve is maintained in its opened position when the sprinkler head and riser tube remain intact with the shutoff valve.

FIG. 2B is a cross-sectional view similar to that shown in FIG. 2A but wherein the sprinkler head shutoff valve has advanced to its closed position as a result of the sprinkler head and the upper position of the riser tube having broken off from the sprinkling system.

FIG. 3 is an exploded view of the shutoff valve shown in FIG. 1 and illustrating optional male and female threaded fittings for the lower water entry port of the sprinkler head shutoff valve.

DETAILED DESCRIPTION OF THE PREFERRED EMBODIMENTS

Within FIG. 1, a portion of an underground sprinkler system is shown, including an underground water delivery pipe 10, a tee connector 12, a riser tube 14, and a lawn sprinkler head 16. Sprinkler head 16 includes a pop-up spray nozzle 18 which rises out of sprinkler head body 20 when water is delivered under pressure by riser tube 14, and which retracts back into sprinkler head body 20 when the source of water is turned off. As shown in FIG. 1, sprinkler head 16 is mounted flush with the surface 22 of the ground 24.

Both water delivery pipe 10 and tee connector 12 shown in FIG. 1 are commonly formed of polyvinyl chloride (PVC) plastic pipe and joined together using a slip-fit cemented by PVC cement. Tee connector 12 includes an upwardly directed female, internally-threaded fitting 26 adapted to threadedly engage the lower externally-threaded end of a plastic riser tube. Similarly, sprinkler head 16 is typically formed with a lower female, internally-threaded fitting 28 (see FIG. 2A) for receiving the upper externally-threaded end of riser tube 14. Many popular sprinkler heads are designed to receive plastic riser tubes having a ½ inch outer diameter and similarly, tee-connectors 12 are commonly available wherein female fitting 26 is adapted to receive the lower end of a plastic riser tube having a ½ inch outer diameter.

As shown in FIG. 1, a sprinkler head shutoff valve 30 is interposed between sprinkler head 16 and upper fitting 26 of tee connector 12. As mentioned above, the purpose of sprinkler head shutoff valve 30 is to stop the further flow of water through plastic riser tube 14 in the event that sprinkler head 16 is removed or if the upper end of plastic riser tube 14 breaks off due to impact or failure. Sprinkler head shutoff valve 30 includes a housing generally designated by reference numeral 32. As shown in FIG. 2A, housing 32 includes a generally cylindrical-shaped central body that is hollow and is closed off by an upper wall 34 and a lower wall 36. Referring to FIG. 2A, housing 32 includes a water exit port 38, in the form of a circular opening within upper wall 34. As shown in FIG. 2A, water exit port 38 is normally in fluid communication with the hollow central body of housing 32. Surrounding water exit port 38 is a female internally-threaded cylindrical opening or fitting 40 adapted to threadedly engage the lower end of plastic riser tube 14. In the preferred embodiment of the present invention, fitting 40 is adapted to receive a plastic riser tube having an outer diameter of ½ inch, although other diameters may certainly be used. Female fitting 40 and plastic riser tube 14 serve to couple water exit port 38 to sprinkler head 16 for delivering water thereto.

As shown in FIGS. 1 and 2A, shutoff valve 30 also includes a water entry port 42 in the form of a circular opening in lower wall 36 of housing 32. Extending downwardly from and surrounding water entry port 42 is a generally cylindrical fitting 44 adapted to couple shutoff valve 30 to water delivery pipe 10 in order to deliver water to the hollow central body of housing 32. Two different embodiments of shutoff valve 30 are shown in the drawings. In a first embodiment shown in FIG. 1 and 2A, lower fitting 44 is a female, internally-threaded fitting identical to upper fitting 40 and adapted to engage the upper, externally-threaded end of a short stub plastic riser tube 46, the lower externally-threaded end of which is engaged with female fitting 26 of tee connector 12. In a second embodiment shown in FIG. 2B, water entry fittine 44' is in the form of an elongated, clyindrical externally-threaded fitting, preferably having an outer diameter of ½ inch, for being directly received by female fitting 26 of tee connector 12.

Referring to FIGS. 2A, 2B and 3, a valve seal member, or plunger, 46 is disposed within housing 32 and includes a central sealing face portion 48 that is generally circular and of a diameter greater than the opening forming water entry port 38. Plunger 46 includes a pair of support arms 50 and 52 extending outwardly in opposing directions from central sealing face portion 48 and terminating in downwardly-turned arcuate flanges 54 and 56, respectively. The distance separating flanges 54 and 56 is commensurate with the inner diameter of housing 32, and the angle of curvature of flanges 54 and 56 is also commensurate with the angle of curvature for the inner side wall of housing 32. In this manner, downwardly turned flanges 54 and 56 support plunger 46 for movement upwardly and downwardly within housing 32, whereby sealing face portion 48 of plunger 46 may be moved toward or away from water exit port 38. As will be obvious to those skilled in the art, when sealing face portion 48 moves upwardly and contacts water exit port 38, the flow of water therethrough is significantly impeded. Provided that sealing face portion 48 is maintained in sealing engagement with water exit port 38, the further flow of water through water exit port 38 is shut off altogether, as shown in FIG. 2B. Hereinafter, the upper position of plunger 46, as shown in FIG. 2B, will be referred to as the closed position of plunger 46, while the lowered position of plunger 46 being spaced apart from water exit port 38, as shown in FIG. 2A, will be referred to as the opened position of plunger 46.

In the preferred embodiment of the present invention, an elastic washer or gasket 58 is provided within housing 32 affixed to upper wall 34 thereof. Gasket 58 includes a central circular opening 60 of approximately the same diameter as water exit port 38. Gasket 58 essentially surrounds water exit port 38 to form a more effective water seal when plunger 46 moves upwardly toward its closed position. As shown in FIG. 2B, central sealing face portion 48 of plunger 46 is brought in contact with gasket 58 to seal off water exit port 38. On the other hand, when plunger 46 is in its opened position, as shown in FIG. 2A, water readily passes around arms 50 and 52 of plunger 46 and flows through water exit port 38.

In the preferred embodiment of the present invention, a means is provided for urging plunger 46 toward its closed position for sealing off water exit port 38. This means for biasing plunger 46 upwardly may be in the form of a coiled spring 62, as shown in FIGS. 2A, 2B and 3. The lower end 64 of spring 62 may either rest upon the upper end of stube riser 46 within water entry post 42 (as shown in FIG. 2A) or within a recessed seat 66 adjacent water entry port 42 (as shown in FIG. 2B). The upper end 68 of spring 62 encircles a downwardly depending boss 70 extending from the underside of plunger 46 below the central sealing face portion 48. Boss 70 prevents the upper end of spring 62 from shifting off of the central portion of plunger 46.

While coiled spring 62 urges plunger 46 to its closed position for sealing off the flow of water through water exit port 38, it will be recalled that the water is to be permitted to flow through shutoff valve 30 so long as sprinkler head 16 remains properly coupled thereto. For this purpose, a depressor, in the form of an elongated rod 72 is provided for maintaining sealing face portion 48 of plunger 46 spaced apart from water exit port 38. As shown in FIG. 2A, the upper end of rod 72 is engaged with the internal radial wall 74 within the internally threaded bore forming female fitting 28 of sprinkler head 16. The upper end of rod 72 is positioned closely adjacent to the internal wall of riser tube 14 to avoid any interference with the lower end 76 of pop-up spray nozzle 18. The length of rod 72 is selected to be slightly in excess of the length of plastic riser tube 14 for causing the lower end of rod 72 to extend through and below water exit port 38 for contacting the upper sealing face 48 of plunger 46. Preferably, rod 72 is selected to be approximately ½ inch longer than plastic riser tube 14 in order to maintain plunger 46 in its opened position spaced apart from gasket 58 by approximately ¼ inch to ½ inch. As shown in FIG. 2A, central sealing face portion 48 of plunger 46 preferably includes a shallow circular depressed region 76 of a diameter less than that of water exit port 38. Depressed region 76 prevents the lower end of rod 72 from shifting off of its centered position upon central sealing face portion 48.

In the event of a sharp impact causing plastic riser tube 14 to break, as shown in FIG. 2B, rod 72 no longer depresses plunger 46, and biasing spring 62 forces plunger 46 to its closed position. Thereafter, the pressure of any water supplied to shutoff valve 30 by water delivery pipe 10 aids in maintaining plunger 46 tightly compressed against gasket 58, forming an even tighter seal. However, the operation of shutoff valve 30 is not dependent upon the local water pressure, and shutoff valve 30 will operate properly with both relatively low and high water pressure.

When installing shutoff valve 30 within existing underground sprinkling systems, the length of plastic riser tubes 14 that are normally used are reduced in height by approximately the height of shutoff valve 30 in order to maintain sprinkler head 16 flush with the surface 22 of ground 24. As shown in FIG. 1, plastic riser tube 14 is often provided with external threads along a substantial portion of its length, including periodic cut-off points for tailoring its length to the needs of a particular system.

In the event that a sprinkler head becomes removed or breaks off from riser tube 14, shutoff valve 30 may easily be reset. The operator simply removes any broken-off portion of the old riser tube 14, installs a new riser tube 14 into upper female fitting 40 of shutoff valve 30, reinserts rod 72 within the new riser tube 14, and replaces sprinkler head 16 atop the new riser tube. As the new sprinkler head 16 is threaded over the upper end of riser tube 14, rod 72 will again depress plunger 46 for permitting water to flow through shutoff valve 30 to the new sprinkler head.

Referring to FIGS. 1 and 3, housing 32 may be formed by two complementary molded plastic components, including an upper half 78 and a lower half 80. Components 78 and 80 may be formed from the same mold and cemented together following insertion of spring 62 and plunger 46. In this event, the lower fitting 44 of the shutoff valve 30 is a female, internally-threaded opening, as shown in FIG. 2A. Alternately, the lower half of housing 32 may be formed of a separately molded component 80' having a male externally-threaded coupling 44' for being directly threaded into tee connector 26, as shown in FIG. 2B.

Those skilled in the art will now appreciate that a simply and inexpensive sprinkler head shutoff valve has been described which helps to conserve water by stopping the flow of water to a site where a sprinkler head and /or riser tube has been removed or has been broken off. While the invention has been described with reference to preferred embodiments thereof, the description is for illustrative purposes only and is not to be construed as limiting the scope of the invention. Various modifications and changes may be made by those skilled in the art without departing from the true spirit and scope of the invention as defined by the appended claims.

We claim:

1. A sprinkler head shutoff valve for stopping the flow of water through a sprinkler head of a sprinkler system, the sprinkler system including a water delivery pipe for delivering water to the sprinkler head, the sprinkler head shutoff valve comprising in combination:

(a) a housing having a generally hollow central body, said housing including a water entry port for coupling to the water delivery pipe to deliver water to said hollow central body, said housing including a water exit port for coupling to the sprinkler head for delivering water thereto, said water exit port being in fluid communication with said hollow central body, wherein said generally hollow central body of said housing is generally cylindrical in shape and includes an inner side wall;

(b) a valve seal member disposed within said housing proximate said water exit port;

(c) support means disposed within said housing for supporting said valve seal member for movement between an opened position spaced apart from said water exit port and a closed position in sealing engagement with said water exit port, wherein said support means includes first and second opposing arcuate flanges separated from one another by a distance commensurate with the inner diamter of said housing, said flanges having an angle of curvature commensurate with the angle of curvature of the inner side wall of said housing for supporting said valve seal member for movement upwardly and downwardly within said housing;

(d) depressor means having a first end for contacting the sprinkler head and an opposing second end extending into said housing through and below said water exit port for contacting said valve seal member, said depressor means causing said valve seal member to assume its opened position spaced apart from said water exit port while the sprinkler head remains coupled to said water exit port, said depressor means permitting said valve seal member to advance to its closed position in sealing engagement with said water exit port when the sprinkler head is uncoupled from said water exit port.

2. A sprinkler head shutoff valve for stopping the flow of water through a sprinkler head of a sprinkler system, the sprinkler system including a water delivery pipe for delivering water to the sprinkler head, the sprinkler head shutoff valve comprising in combination:

(a) a housing having a generally hollow central body, said housing including a water entry port for coupling to the water delivery pipe to deliver water to said hollow central body, said housing including a water exit port for coupling to the sprinkler head for delivering water thereto, said water exit port being in fluid communication with said hollow central body;

(b) a valve seal member disposed within said housing proximate said water exit port;

(c) support means disposed within said housing for supporting said valve seal member for movement between an opened position spaced apart from said water exit port and a closed position in sealing engagement with said water exit port; and (d) depressor means having a first end for contacting the sprinkler head and an opposing second end extending into said housing through and below said water exit port for contacting said valve seal member, said depressor means causing said valve seal member to assume its opened position spaced apart from said water exit port while the sprinkler head remains coupled to said water exit port, said depressor means permitting said valve seal member to advance to its closed position in sealing engagement with said water exit port when the sprinkler head is uncoupled from said water exit port, said depressor means being an elongated rod having a predetermimed diameter;

(e) wherein said valve seal member includes a central portion having a shallow circular depressed region of a diameter less than that of said water exit port, but large enough to avoid contacting the entire diameter of the rod, for preventing the second end of said rod from shifting off of a centered position upon the central portion of said valve seal member.

3. A sprinkler head shutoff valve for stopping the flow of water through a sprinkler head of a sprinkler system, the sprinkler system including a water delivery pipe for delivering water to the sprinkler head, the sprinkler head shutoff valve comprising in combination:

(a) a housing having a generally hollow central body, said housing including a water entry port for coupling to the water delivery pipe to deliver water to said hollow central body, said housing including a water exit port for coupling to the sprinkler head for delivering water thereto, said water exit port being in fluid communication with said hollow central body, wherein said generally hollow central body of said housing includes an inner side wall;

(b) a valve seal member disposed within said housing proximate said water exit port;

(c) support means disposed within said housing for supporting said valve seal member for movement between an opened position spaced apart from said water exit port and a closed position in sealing engagement with said water exit port; and (d) depressor means having a first end for contacting the sprinkler head and an opposing second end extending into said housing through and below said water exit port for contacting said valve seal member, said depressor means causing said valve seal member to assume its opened position spaced apart from said water exit port while the sprinkler head remains coupled to said water exit port, said depressor means permitting said valve seal member to advance to its closed position in sealing engagement with said water exit port when the sprinkler head is uncoupled from said water exit port, and wherein said support means includes first and second opposing flanges engaging opposing sides of said inner side wall of said housing for supporting said valve seal member for movement upwardly and downwardly within said housing.

* * * * *